United States Patent [19]

Ovitz, III

[11] 4,256,043

[45] Mar. 17, 1981

[54] DISPLAY SYSTEM FOR SAMPLE ARTICLES

[75] Inventor: Ernest G. Ovitz, III, Galva, Ill.

[73] Assignee: John H. Best & Sons, Inc., Galva, Ill.

[21] Appl. No.: 48,594

[22] Filed: Jun. 14, 1979

[51] Int. Cl.[3] ..... A47B 41/04

[52] U.S. Cl. ..... 108/29; 211/134; 248/243

[58] Field of Search ..... 108/29, 31, 32, 108; 211/45, 49 D, 134, 135, 169; 248/243; 52/27, 36

[56] References Cited

U.S. PATENT DOCUMENTS

| | | | |
|---|---|---|---|
| 3,321,089 | 5/1967 | Krikorian | 211/134 |
| 3,469,711 | 9/1969 | Swaneck et al. | 108/108 X |
| 3,517,623 | 6/1970 | Goldstein et al. | 248/243 X |
| 3,643,808 | 2/1972 | Ryan | 211/134 X |
| 3,661,273 | 5/1972 | Crosslen | 211/169 |
| 3,808,710 | 5/1974 | Ackerman et al. | 211/45 X |
| 3,983,822 | 10/1976 | Suttles | 248/243 X |

*Primary Examiner*—Roy D. Frazier
*Assistant Examiner*—Peter A. Aschenbrenner
*Attorney, Agent, or Firm*—Kinzer, Plyer, Dorn & McEachran

[57] ABSTRACT

A display system for sample articles having a variety of display configurations supported on a plurality of upright support members. The sample articles can be arrayed in various hanging configurations or on either horizontal or angled shelves. Each display configuration has support members including brackets with standard shaped hooks for attachment to the upright support members.

6 Claims, 12 Drawing Figures

52
48
46
44
50
22
56
58
54
60
62
64
10
14
86
88
88A
88B
90
92
94
96

DISPLAY SYSTEM FOR SAMPLE ARTICLES

SUMMARY OF THE INVENTION

This invention relates to a display system adapted to support flat sample articles in a variety of display configurations. The preferred embodiment of the invention will be described in terms of displaying carpet samples for wholesale or retail trade but the display system may be used equally well to display tile samples, wall panel samples, wall paper samples or any other generally flat material.

A primary object of the invention is a display system which is so devised and constructed that the user can easily assemble it at the point of sale using simple fasteners, connectors and supports.

Another object is a display system which will accomodate a multitude of display configurations.

Another object is a display system which supports a plurality of samples such that a customer may easily glance at and handle several samples for comparison.

Another object is a display system wherein samples may be displayed attractively as a feature of customer appeal.

Another object is a display system wherein various display configurations utilize standard shaped hooks so that a single type of upright support will accomodate a variety of display methods.

Another object is a display system which can be adapted to either wall mounting or a free standing display.

Other objects will appear from time to time in the following specification.

DETAILED DESCRIPTION OF THE INVENTION

Figure 1:
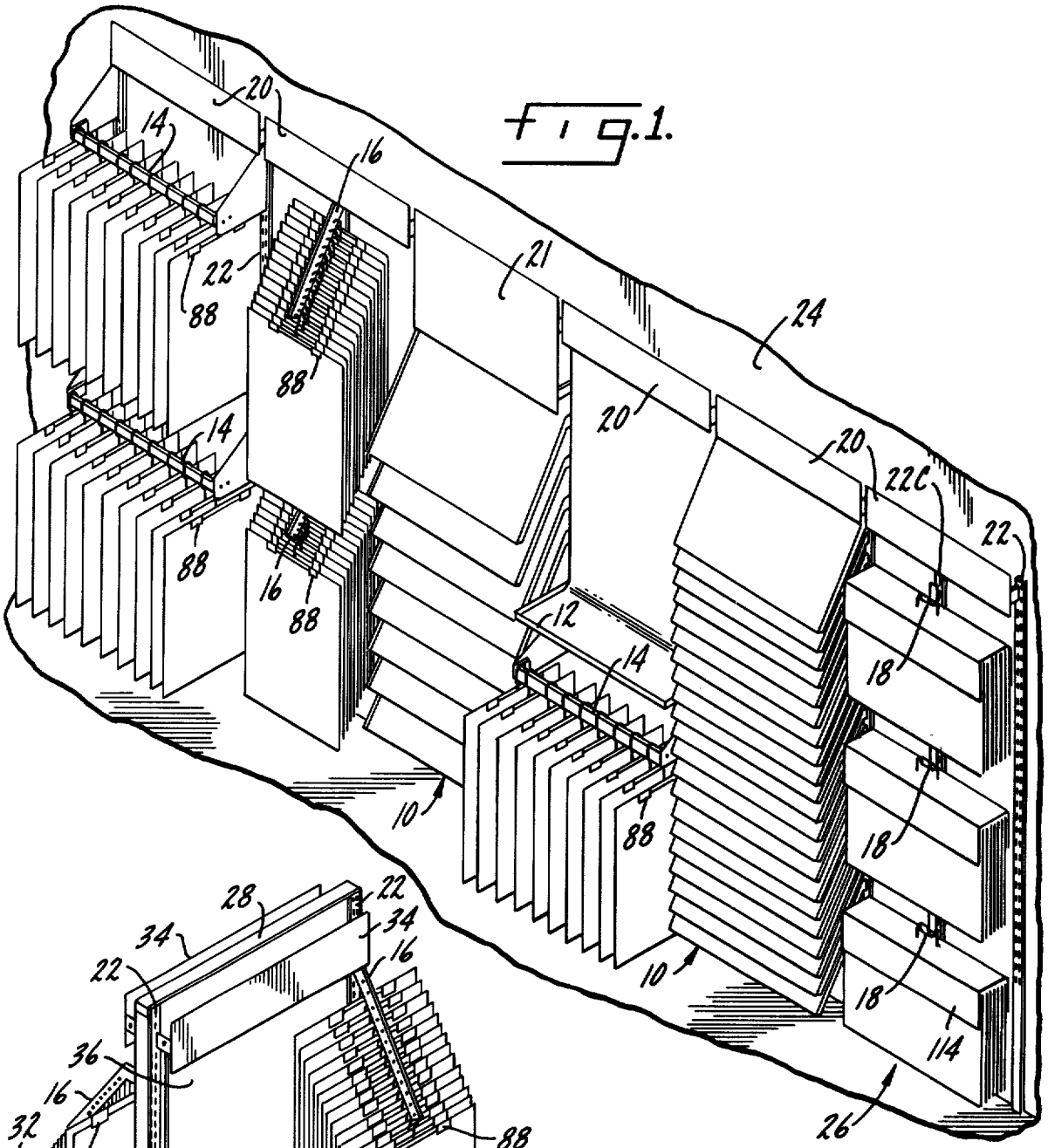
FIG. 1 is a perspective view of a wall mounted display system according to the present invention.

A display system constructed in accordance with the present invention is shown in FIG. 1. This system is constructed to display carpet samples or other articles in a variety of configurations. The configurations include display shelves 10, a vignette shelf 12, hanger rails 14, cantilever arms 16 and binder hangers 18. The top of each display may have a header 20 or message board 21 on which identifying or informational material may be printed. All parts of the display system are supported on upright support members such as that shown at 22. In FIG. 1 the support members are shown as being fastened to a wall 24 with the bottom of the support resting on a floor 26.

Figure 2:
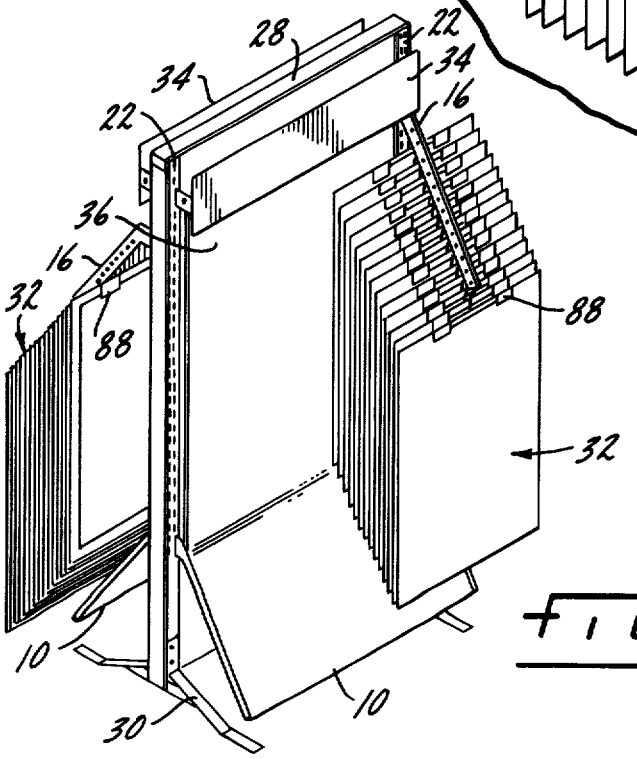
FIG. 2 is a perspective view of a display system utilizing a free standing support.

The present invention can also be utilized in a free-standing display as shown in FIG. 2. The upright support members 22 are joined by a top cross brace 28 with a suitable base member 30 holding the assembly up. FIG. 2 shows a plurality of carpet samples 32 being supported by cantilever arms 16. This particular display also includes vignette headers 34 on each side of the display. These headers support a hanging sample 36 in a manner which will be described below. The sample 36 extends on each side to a single display shelf 10. It will be understood that a variety of display configurations could be used in this free-standing display. For example, a binder hanger could be added to the support member which is shown in the foreground.

Figure 3:
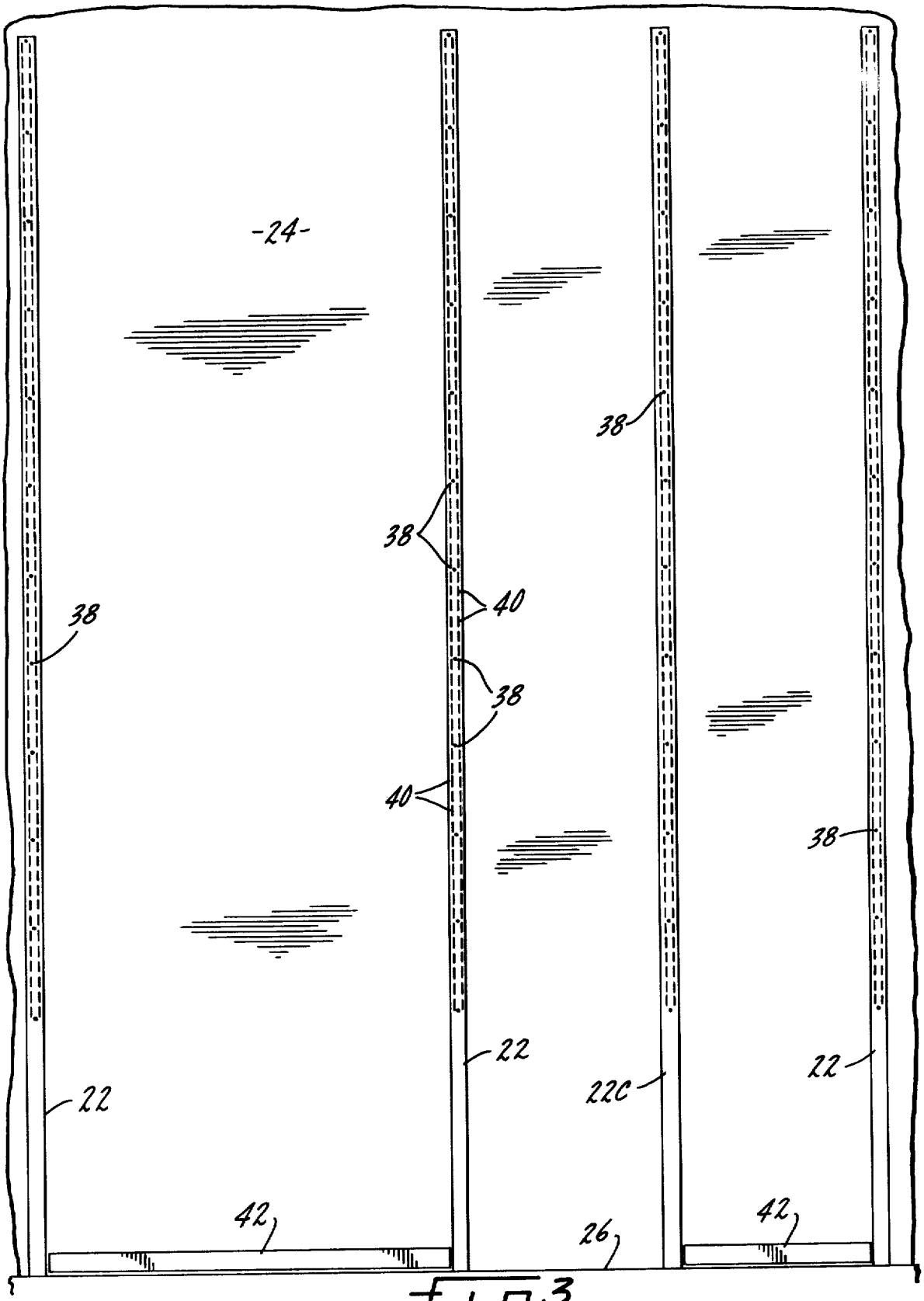
FIG. 3 is a front elevation view of wall mounted upright support members shown with various spacing.

The upright support members are shown in FIG. 3. The support members 22 are slotted channel members, preferably made of aluminum but other materials could be used. In a wall mounting, these upright support members rest on the floor and are held to the wall by screws shown schematically at 38. The channels have a double row of slots 40. In a typical installation, the support members may be on the order of seven feet high with the slots starting about 1½ feet from the floor 26. In such a typical application, the support members are spaced on the order of 27 inches apart, although half channel spacing of 13 inches may be used where economy of wall space is critical. Spacer sticks 42 may be supplied with the display system to assure proper spacing. Half channel spacing results in the positioning of a central upright support member 22C which can be used for cantilever arm and binder hanger applications, as will be explained more fully below.

Details of a display shelf 10 can be seen in FIGS. 4–7. This shelf comprises a frame member 44 which may be a stamped part from a single piece of aluminum stock. The frame has a pair of 90° notches 46 cut therein. A portion of the frame is bent at essentially 90° to form flanges 48. In addition, the portion of the frame between the two notches 46 is bent slightly inward towards the flanges 48 to form a lip 50. At the ends of the frame 44, are brackets 52. The brackets have a pair of hooks 54 suitably shaped to fit into the slots 40 of a selected support member 22. The hooks fit in a sliding interlocking engagement with the slots, that is, a shelf frame will be supported by a selected pair of uprights; the brackets 52 and hooks 54 are so oriented that the shelf frame will project forwardly from the upright at a downwardly inclined angle.

Figures 4, 5, 6, 7, 10:
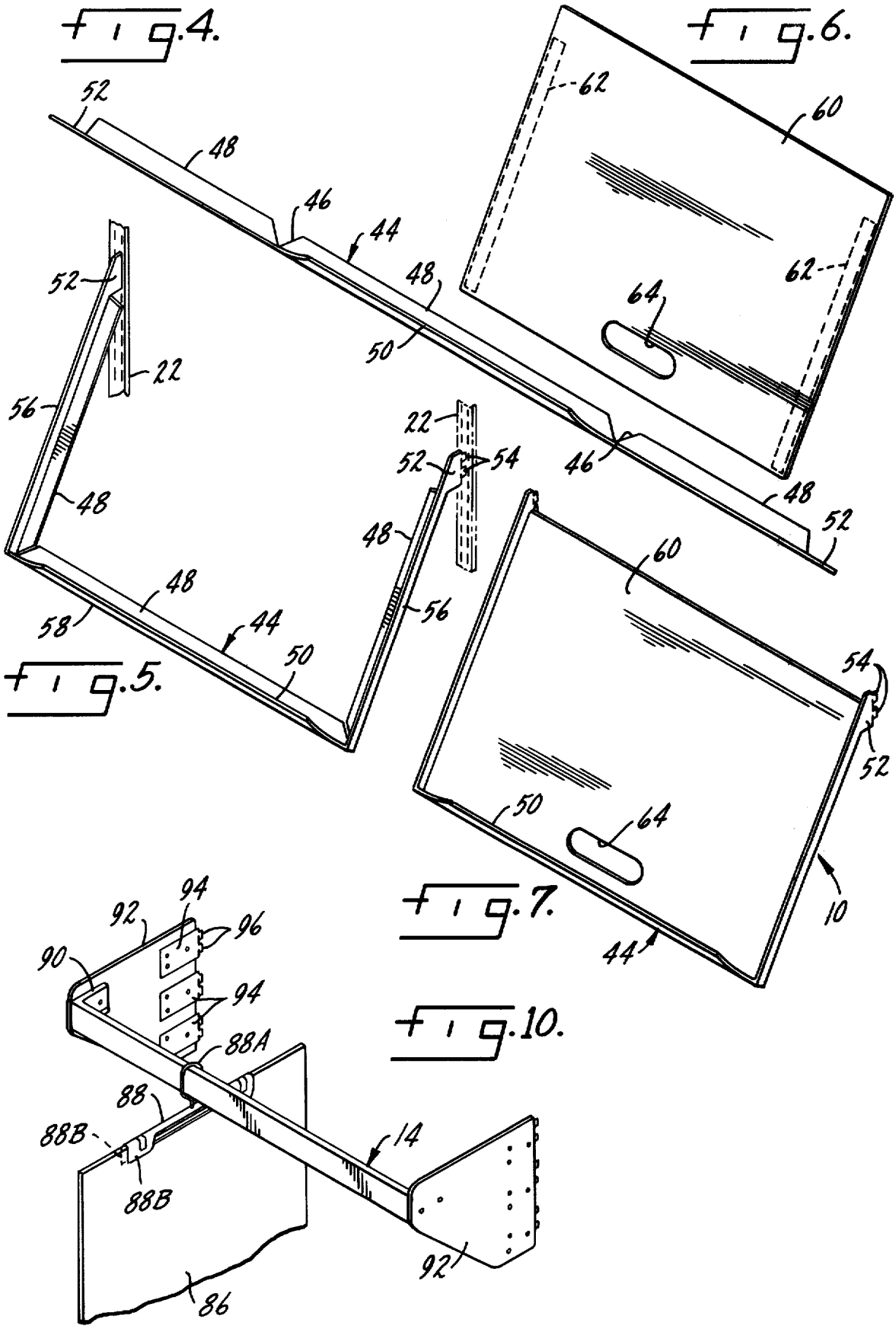
FIG. 4 is a perspective view of a display shelf frame prior to bending of the frame into its final shape.
FIG. 5 is a perspective view of the display shelf frame as it would be inserted into the support members.
FIG. 6 is a perspective view of a shelf member.
FIG. 7 is a perspective view of the completed display shelf.
FIG. 10 is a perspective view of a hanger rail.

The frame member 44 may be shipped to the user in the form shown in FIG. 4. The user then simply bends the frame member at the notches 46 to form the three-sided frame shown in FIG. 5. The frame consists of a pair of side arms 56 joined by a front bar 58. The user can then latch the frame to the slotted channel.

A shelf 60, preferably made of corrugated cardboard, has a pressure sensitive adhesive along two sides (FIG. 6). The adhesive is covered by removable tape 62 until the shelf is ready for installation into a frame member. The shelf simply sets into the frame where it is supported by the flanges 48. Once pressed firmly in place, the adhesive on the underside of the shelf 60 will hold the shelf in the frame. A carpet sample or other similar item can then be placed in the display shelf with the lip 50 serving to retain the sample in the shelf. A cutout 64 is provided in the shelf 60 to allow a customer to remove a sample by reaching underneath the shelf and pushing the sample out.

Figures 8, 9, 11, 12:
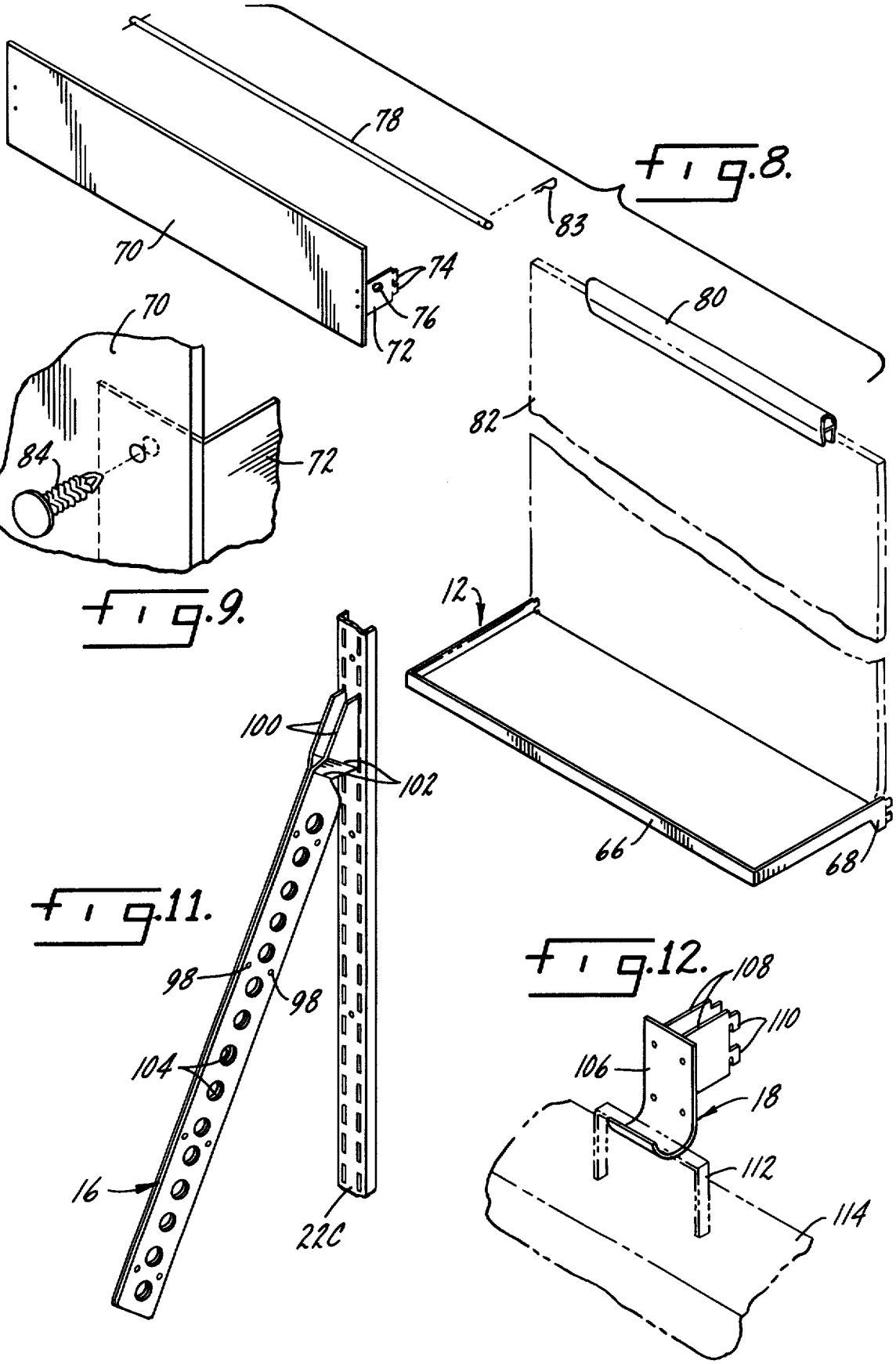
FIG. 8 is a exploded perspective view of one of the display configurations, comprising a vignette shelf and header with a display shown in phantom.
FIG. 9 is a detail perspective view showing the connection of the vignette header and bracket.
FIG. 11 is a perspective view of a cantilever arm.
FIG. 12 is a perspective view of a binder hanger with a binder shown in phantom.

A variable form of the display shelf 10 is the vignette shelf 12 shown in FIG. 8. The vignette shelf has a frame 66 which is constructed in a manner similar to the frame 44 with the exception of the bracket configuration. In the vignette shelf frame, the bracket 68 is constructed so that the shelf is horizontal. Thus, objects other than two-dimensional samples can be placed on this type of shelf.

A suitable backdrop for the vignette shelf can be provided in conjunction with a vignette header 70. The header board, made of hardboard, may have suitable information material printed thereon. The board is fastened to a pair of brackets 72 having hooks 74 for insertion into one of the upright support members. There is a hole 76 in the brackets 72 through which a hanger rod 78 may be placed. The hanger rod extends through a hanger clip 80 which in turn holds a backdrop 82 in a hanging manner. The backdrop may be a large size sample or any other suitable material. A hairpin clip 83 is insertable into the hanger rod 78 to prevent the rod from sliding out of the hanger clip 80.

The vignette header board 70 is fastened to the brackets 72 by insertion of the Christmas tree type fastener 84 (FIG. 9). The user can make this connection with no special tools required.

The hanger rail type of display configuration is shown in FIG. 10. In this display form, a carpet sample 86 is held by a hanger clip 88 suspended by a wire hook 88A which is in turn placed on a hanger rail 14. The hanger clips 88 are U-shaped one-piece plastic extrusions presenting a pair of spaced flanges 88B having inherent leaf spring action of clamping the upper edge of a carpet sample inserted therebetween. The hanger rail 14 is preferable made from aluminum channel material. The hanger rail has corner mebers 90 at its ends, providing attachment elements for connection to a pair of side panels 92. A plurality of brackets 94 are attached to the inside edges of the side panels 92. The brackets 94 have the standard-shaped hooks 96 for insertion into the selected slots of the upright support members. Brackets are secured to the side panels by pop rivets and attachment of the brackets to the side panels may be performed by the user.

Another form of hanging display is the cantilever arm arrangement shown in FIG. 11. This form of display has a cantilever arm 16 extending downwardly from and at an angle to an upright support member 22C. The cantilever arm is formed from two stamped parts, held back-to-back by rivets 98. The upper end of the arm has a pair of brackets 100 shown with the bracket hooks already inserted into the slot of the upright support member. These brackets are offset slightly from the plane of the cantilever arm by complemental bends as at 102 which create the desired separation between the bracketed pairs. This separation is equal to the distance between the rows of slots in a support member. The cantilever arm has a plurality of holes 104. A sample hanger such as that shown at 88 in FIG. 10 can be inserted into the holes 104.

Another hanging type of display is the binder hanger 18 of which the details are shown in FIG. 12. This configuration utilizes a J-shaped finger hook 106 attached to a pair of brackets 108. The brackets having the standard-shaped hooks 110 for insertion into the support member slots. The J-shaped hook supports the handle 112 of a binder 114 in which carpet samples are captured as best shown in FIG. 1.

It will be noted that both the cantilever arm and the binder hanger support the sample articles such that the surface of the article is in facing relation with a viewer who is standing in front of the display. Also, it is preferred to mount the cantilever arm and binder hanger on a central support member 22C, as shown in FIG. 1. The samples are thereby centered to present an overall symmetry when used with the other types of display. However, it is not absolutely necessary that this be done.

As can be seen in FIG. 1, a preferred arrangement for the display system of the present invention is to use the various display configurations in generally columnar fashion. The central mounting of cantilever arms 16 and binder hangers 18 is with respect to these columns. The top of these columns may be provided with a header 20 or message board 21. These are simply signboards made of some suitable material, attached to brackets and fitting into the support members. One of the advantages of having a double row of slots in the support members is that support members located on the inside of the overall display system can receive bracket hooks from adjacent columns. That is, a single support member acts both as the left-hand side of one column and the right-hand side of the next adjacent column.

It will be realized that whereas a practical and operable display system has been shown and described, nevertheless, many changes may be made in size, shape and disposition of parts without departing from the spirit and scope of the invention. For example, the particular arrangement of display configurations in FIG. 1 is by no means the only arrangement which could be utilized. It is therefore desired that the description and drawings be taken in a broad sense as illustrative rather than as limiting the invention to the specific showing.

I claim:

1. A sample display system for displaying carpet wares, comprising:

a plurality of uprights adapted to be fastened to a wall, each upright having hook-receiving openings formed thereon;

a plurality of cantilever arms each having a hook at one end to be inserted into an opening in an upright to suspend the arm thereon, the arm extending outwardly from the wall and downwardly from the point where the hook is inserted in the opening, and each arm having a row of openings;

a plurality of carpet hangers each having a wire hook to be inserted in the opening of a cantilever arm, each wire hook supporting a clip having spaced leaf-spring flanges adapted to clamp the edge of a carpet sample;

a plurality of shelf frames each bent from a single piece of metal and comprising a pair of side arms joined by a front bar, said side arms and front bar each having flanges bent therefrom to support a shelf, and said side arms having ends terminating in hook brackets adapted to be hooked to openings in a selected pair of the uprights so that each shelf will project forwardly from the selected uprights and downwardly from the point where the hooks are inserted in the opening; and an elongated hanger rail with hook means at the ends thereof adapted to be hooked to selected uprights to extend horizontally therebetween.

2. A sample display system according to claim 1 further comprising a plurality of J-shaped support members, each having at least one hook thereon for attachment to an upright.

3. A sample display system according to claim 1 further comprising at least one shelf frame bend from a single piece of metal and comprising a pair of side arms joined by front bar, said side arms and front bar each having flanges bent therefrom to support a shelf, and said side arms having ends terminating in hook brackets adapted to be hooked to openings in a selected pair of the uprights so that the shelf will project forwardly from the selected uprights in a horizontal position.

4. A sample display system according to claim 3 further comprising a generally planar header attached to the top of the selected upright by brackets, said brackets having holes therein for receiving a hanger rod, the hanger rod extending through a hanger clip, the hanger clip supporting a carpet sample.

5. A sample display system according to claim 1 wherein the hanger rail comprises a pair of side panels with hook means at the ends thereof, the rail member attached to and extending between the side panels with corner members integrally formed at the ends of the rail member, providing attachment elements for connection to the side panels.

6. A sample display system according to claim 1 further comprising a plurality of generally planar headers having brackets adapted to be inserted into a selected pair of uprights.

* * * * *